US009907381B2

(12) United States Patent
Tussey

(10) Patent No.: US 9,907,381 B2
(45) Date of Patent: Mar. 6, 2018

(54) HEAD HAIR WRAP CAP FOR COVERING OR PROTECTING THE HEAD AND/OR HAIR

(71) Applicant: Julie A. Tussey, New York, NY (US)

(72) Inventor: Julie A. Tussey, New York, NY (US)

( * ) Notice: Subject to any disclaimer, the term of this patent is extended or adjusted under 35 U.S.C. 154(b) by 66 days.

(21) Appl. No.: 14/544,462

(22) Filed: Jan. 9, 2015

(65) Prior Publication Data

US 2016/0198830 A1 Jul. 14, 2016

(51) Int. Cl.

| | |
|---|---|
| ***A42B 1/06*** | (2006.01) |
| ***A45D 8/40*** | (2006.01) |
| ***A42B 1/04*** | (2006.01) |

(52) U.S. Cl.

CPC ..... *A45D 8/40* (2013.01); *A42B 1/041* (2013.01)

(58) Field of Classification Search

CPC .. A42B 1/12; A42B 1/04; A42B 1/041; A45D 44/08; A45D 44/12; A41D 23/00; A41G 5/0093

See application file for complete search history.

(56) References Cited

U.S. PATENT DOCUMENTS

| | | | | |
|---|---|---|---|---|
| 2,211,184 A | | 3/1940 | Varell | 2/174 |
| 2,694,204 A | * | 11/1954 | Cross | A42B 1/041 2/174 |
| 3,268,913 A | | 8/1966 | Gettinger | 2/171 |
| 3,287,737 A | * | 11/1966 | Schuessler | A42B 1/041 2/173 |
| 4,468,818 A | | 9/1984 | Flannery | 2/207 |
| 5,007,115 A | | 4/1991 | Denbow et al. | 2/208 |
| 5,062,157 A | | 11/1991 | Muta | 2/171 |
| 5,144,696 A | | 9/1992 | Kahl | 2/207 |
| 5,365,613 A | * | 11/1994 | Henegan | A42B 1/041 2/171 |
| 5,490,528 A | * | 2/1996 | Day | A42B 1/04 132/200 |
| D388,589 S | | 1/1998 | Walker | D2/867 |

(Continued)

FOREIGN PATENT DOCUMENTS

| | | | |
|---|---|---|---|
| GB | 2296180 | 6/1996 | A42B 1/04 |

OTHER PUBLICATIONS

"Turbie Twist", suber absorbent hair towel, found at http://www.turbietwist.com/.

(Continued)

*Primary Examiner* — Sally Haden

(74) *Attorney, Agent, or Firm* — Ernest D. Buff & Associates, LLC; Ernest D. Buff, Esq.; Margaret A. LaCroix, Esq.

(57) ABSTRACT

A hair wrap envelopes the hair. The hair wrap comprises a cap portion, a pouch, and side walls. The cap portion has at least one attachment means. At least two elongated ties located on opposite sides of the side walls are adapted to be twisted for securing the wrap on the user's head. A material loop is located on a back base of the pouch to hold the ties in place. An attachment means located on a bottom edge of the pouch mates with the attachment means of the cap portion. A crown loop located on the top section is adapted to hold the pouch after the pouch is twisted and lifted toward the top section. The pouch is adapted to lay untwisted when the wrap is in an extended position, and to be twisted and lifted upward when the wrap is in a wrapped position.

17 Claims, 12 Drawing Sheets

(56) References Cited

U.S. PATENT DOCUMENTS

| | | | | |
|---|---|---|---|---|
| D412,234 | S | 7/1999 | Cox | D2/867 |
| 5,920,909 | A | 7/1999 | Ellsworth et al. | 2/171 |
| 6,330,721 | B1 * | 12/2001 | Wallace | A42B 1/12 2/174 |
| 6,427,251 | B1 | 8/2002 | Leach | 2/174 |
| 7,096,510 | B2 | 8/2006 | Yeadon | 2/202 |
| 7,412,729 | B1 | 8/2008 | Mcgovern | 2/174 |
| 8,032,950 | B2 | 10/2011 | Leftenant | 2/202 |
| D669,662 | S | 10/2012 | Reid | D2/867 |
| 8,316,466 | B2 | 11/2012 | Saito | 2/204 |
| 2002/0108164 | A1 * | 8/2002 | Dixon | A42B 1/041 2/171 |
| 2003/0200594 | A1 * | 10/2003 | McGreggor | A42B 1/041 2/202 |
| 2003/0221243 | A1 * | 12/2003 | Phillips | A42B 1/041 2/202 |
| 2006/0048277 | A1 | 3/2006 | Yeadon | 2/204 |
| 2006/0272073 | A1 * | 12/2006 | Marquardt | A42B 1/041 2/171 |
| 2007/0056079 | A1 * | 3/2007 | Didier | A42B 1/041 2/171 |
| 2007/0214545 | A1 | 9/2007 | Rhodes | 2/207 |
| 2008/0209614 | A1 * | 9/2008 | Beausang | A41D 23/00 2/207 |
| 2008/0229479 | A1 * | 9/2008 | Butterly | A45D 19/18 2/174 |
| 2009/0025119 | A1 * | 1/2009 | Nespor | A41D 7/008 2/84 |
| 2009/0089916 | A1 | 4/2009 | Leftenant | 2/204 |
| 2009/0126078 | A1 | 5/2009 | Rashid | 2/207 |
| 2010/0275946 | A1 * | 11/2010 | Ruschell | A41D 20/00 132/210 |
| 2012/0079643 | A1 * | 4/2012 | Clarke | A42B 1/041 2/171 |
| 2012/0210492 | A1 * | 8/2012 | Bielobocky | A41D 23/00 2/207 |
| 2012/0240309 | A1 * | 9/2012 | Albright | A42B 1/041 2/181 |

OTHER PUBLICATIONS

Internet Publication "Head Covers", hats, turbans and wigs for hair loss, found at http://www.headcovers.com/ht/head_wraps/?gclid=CjwKEAjw8_idBRCExfC15My3owwSJACSDX_WE4WscHH437ZheswEJjU8xJF_pdOaO6rN4VuXWX6XChoC3k_w_wcB.

* cited by examiner

HEAD HAIR WRAP CAP FOR COVERING OR PROTECTING THE HEAD AND/OR HAIR

1. FIELD OF THE INVENTION

The present disclosure generally relates to head wraps and/or headscarves used when caring for hair; and more particularly to head wraps that envelope hair of the head for use in keeping hair dry, or to protect a hair style.

2. DESCRIPTION OF THE PRIOR ART

Head wraps, headscarves and hair caps are typically provided for covering most (or all) of the top of a persons, typically a woman's, hair and head. They are worn for a multitude of reasons, including for warmth, fashion, social distinction, for religious purposes, to hide baldness, to manage hair, or as a protective hair covering.

Examples of various head wraps, headscarves and hair caps are set forth summarily below:

U.S. Pat. No. 2,211,184 to Varell discloses a protective hair covering device; and more particularly, a band made of a strip of flexible water-resistant sheet material having a configuration that is adapted to be placed about the head to form a completely closed circular band, enveloping the hair throughout.

U.S. Pat. No. 3,268,913 to Gettinger discloses an adjustable sleep turban.

U.S. Pat. No. 4,468,818 to Flannery discloses a head scarf construction embodying the cooperation of a ply of fabric in a triangulated shape and a stiffened triangulated component connected in positions to bring the base margins of the triangles into alignment, the addition of surface decorations for the triangulated shapes to develop simulations of birds or animals, and tie elements for securing the scarf to the wearer's head.

U.S. Pat. No. 5,007,115 to Denbow et al. discloses a tubular garment which is worn around the neck and optionally at a variety of positions on the head, to provide protection which can easily be adjusted in response to weather conditions. Wearing positions range from covering the neck only, to covering the entire head, including the mouth, cheeks and forehead. The garment's tubular shape is characterized by having the ends of the tube at angles of less than 90 degrees to the sides of the tube. The angled ends provide the adjustability in wearing positions by creating a variation in the length of the tube sides from a maximum at the back of the garment to minimum at the front. The end of the tube which optionally covers the head is further characterized by a drawstring which allows adjustment in the circumference of the end, thus providing a means of securing the garment in the chosen wearing position.

U.S. Pat. No. 5,062,157 to Muta discloses a headband towel head covering held in place by extended strips which fasten together at the back of the head. The towel is pulled back over the head and held in place with fasteners placed on both the towel and the extended strips. It is pulled forward over the head, for removing perspiration and grime from the face and neck area, and conveniently returned over the head during activity. It is also useful to protect from heat or sun while doing heavy physical work, sports activities, lying on the beach, and the like. Alternatively, the headband closure member comprises an elastic-containing band to effect a firm positioning about one's head.

U.S. Pat. No. 5,144,696 to Kahl discloses an article of clothing comprising an elongated fabric tube and a generally circular elastic band wherein, by passing the band over different parts of the tube, various decorative and functional article forms are provided.

U.S. Pat. No. 5,365,613 to Henegan discloses a hair drying turban made from a single piece of absorbent cloth and having a cap portion and, extending forwardly, a hair basket portion. In use, the wearer places the cap portion on his or her hair with the hair extending forwardly over the forehead and face (the wearer bending at the waist). Then, with the hair placed neatly within the hair basket portion, the hair basket is twisted about the longitudinal axis of the hair. The hair basket portion is then folded backwardly along the center line of the cap portion and secured to the back of the cap portion. A loop is provided for allowing the turban to be easily hung on a door peg and/or, alternatively, to facilitate the tucking in of the hair basket portion beneath the cap portion.

U.S. Pat. No. 5,920,909 to Ellsworth et al. discloses a hair wrap having an annular shape with upper and lower annular edges, having elastic therein, defining upper and lower expandable openings which permit the hair wrap to be placed over the head and down around the neck of the wearer. A pliable material, intermediate the upper and lower annular edges of the hair wrap provides a pocket at the rear of the hair wrap for receiving the hair of the wearer. In use, the hair wrap is passed over the head and down around the neck of the wearer with the hair of the wearer extending over the rear portion of the hair wrap. The front of the hair wrap is then raised above the forehead and the hair extending over the rear of the hair wrap is inserted into the rear pocket of the hair wrap to confine the hair.

U.S. Pat. No. 6,427,251 to Leach discloses a towel wrap for the head comprising a pouch made of a towel-type fabric, the pouch consisting of a generally rectangular piece of fabric having a horizontal bottom edge approximately four feet in length, a top edge spaced above the bottom edge and including a pair of curved flaps, a pair of spaced vertical side edges connecting from the top edge to the bottom edge to form the generally rectangular piece, the flaps having peaks which are about two feet from the bottom edge and the top edge having a center portion which is about 15 inches from the bottom edge, the bottom edge having a portion about two inches wide which is folded over and stitched back on to the fabric so as to provide a two inch wide belt which extends horizontally between the two side edges.

U.S. Pat. No. 7,096,510 to Yeadon discloses a head covering commonly known as a skull cap in which the 'tail' extending from the back of the neck is fashioned into a pouch with an elasticized opening.

U.S. Pat. No. 7,412,729 to Mcgovern discloses a head covering with pocket that can be easily removed and installed with the use of tie strips. A piece of elastic insures that the device will fit on all shaped heads.

U.S. Pat. No. 8,032,950 to Leftenant discloses a head covering is described that is positioned on a head of a wearer to retain the wearer's hair in a desired position. The head covering comprises a hooded cap and an extension. The hooded cap includes a pair of ties and a set of straps.

U.S. Design Pat. No. D388589 to Walker discloses a head wrap of soft fabric.

U.S. Design Pat. No. D412234 to Cox discloses a turban.

U.S. Design Pat. No. D669662 to Reid discloses a headwrap with pouch for hair.

U. S. Patent Application No. 2009/0089916 to Leftenant discloses a head covering consisting of: a hooded portion that sits on top of the wearer's head, a back portion containing a pocket/passageway for the hair/braids to pass through, middle and bottom straps positioned on the back portion of the invention to hold the hair/braids in place.

Foreign Patent Application No. GB2296180 to Parry discloses an enveloping wrap for a head of long hair formed as a pouch by two elongate toweling sheet-sections of tapering crescent shape stitched together along an outwardly-curving seam. An open-mouth cap portion receives the crown of the head, and a fillet stitched between inwardly-curved elasticized edges of the sheet-sections defines a pocket for receiving and enveloping the hair within a lower tail portion of the pouch. The tail portion is wound upon itself to twist the enveloped hair tightly within the wrap, and then folded over the cap portion for retention there using an elastic loop. The mouth of the pocket may be closed up onto the hair using a draw string and closed from use using a press-stud fastening.

Internet Publication "Turbie Twist", super absorbent hair towel, found at http://turbietwist.com/discloses superabsorbent hair towel for drying wet hair generally formed having a pouch and a loop to secure the towel on the head.

Internet Publication "Head Covers", hats, turbans and wigs for hair loss, found at http://www.headcovers.com/ht/head_wraps/?gclid=CjwKEAjw8_idBRCExfC15My3oww SJAC SDX_WE4WscHH437ZheswEJjU8xJF_pdOaO6r N4VuXWX6XChoC3k_w_wcB discloses head scarves and wraps.

Despite the aforementioned head wraps, headscarves and hair caps problems in hair care still exist. For example, head wraps/headscarves and/or caps are not adequately secured and as a result, the wraps or scarves fall from the head exposing the hair. Other head wraps/headscarves and/or caps are placed upon the hair in such a manner so that the hair becomes matted and disheveled, completely destroying the hair style.

Accordingly, there exists a need for a head wrap hair cap combination particularly suitable for caring for hair that is securely placed on the head without loosening and falling off. Further, there is a need in the art for a head wrap hair cap combination that completely encapsulates the hair to protect the hair from the elements, as well as to protect the hair style from tangling and matting.

SUMMARY OF THE INVENTION

The present invention provides a head wrap hair cap combination that is readily transformed into a wrap structure that envelopes and fully contains hair resident on the wearer's head. Generally stated, the subject head wrap hair cap combination is formed with a cap portion having two ties and terminating to an elongated pouch. While the cap portion protects the hair on the crown of the head, the elongated pouch receives and houses hair extending from the head. There are generally four (4) hair lengths-short, medium, long and extra long lengths—all of which are readily accommodated by the subject head wrap hair cap combination which is constructed in four (4) different sizes or lengths to correspond to short, medium, long and extra long hair lengths or for the desired style.

A head wrap hair cap combination according to the invention is appointed for use in the shower and/or rain to keep hair dry, or to protect hair styles while sleeping, exercising, running errands or during indoor and/or outdoor chores, work or activities. A terry cloth interior is provided to give the option of wearing the wrap after a shower or bath when the hair is wet. Alternatively, a silk interior is provided rather than terry cloth for dry, damp or otherwise non-wet hair, to keep the hair from frizzing up while being worn for a variety of activities, including sleeping, exercising or for fashion when being worn out and about. Improvements to current shower caps are yielded through the use of the hair wrap/cap. While other wrap type devices are generally made to mimic a towel when hair is wet, the subject hair wrap is adapted to provide an improved shower cap designed for hair. The subject hair wrap/cap is adapted to be twisted up or left undone hanging on the back (so hair style is not ruined). Preferably, the exterior is water proof/resistant material is designed to keep the hair dry while maintaining a well kempt style. It also can be used to protect hairstyle in the shower or rain, while sleeping or working-out/exercising, and forms a fashionable head wrap when running errands around town.

Generally stated, the subject head hair wrap/cap and method of use is adapted to protect hair from water or from the environment, providing a shower, rain, sleep, workout and/or fashion cap. In a first embodiment the hair wrap comprises a main body having an interior and an exterior and having a top section forming a cap portion with a perimeter rim, a bottom section forming a pouch, and side walls. The cap portion has at least one attachment, fasten, means located on the exterior of the main body, wherein the cap portion is appointed to fit a head. At least two elongated ties are provided, located on opposite sides of the side walls. The ties are adapted to fall to sides of a users ears and adapted to be pulled down and around then up over the user's head, and to be twisted in front of the top section for securing the wrap on the user's head and mitigating water entry. A material loop located on a back base of the pouch is adapted to receive and hold the ties in place. An attachment means, preferably comprising an elastic loop, is located on a bottom edge of the pouch. The attachment means is adapted to mate with the attachment means of the cap portion. A crown loop located on the top section is adapted to hold the pouch after the pouch is twisted and lifted toward the top section. Whereby the pouch is adapted to lay untwisted when the wrap is in an extended position and whereby the pouch is adapted to be twisted and lifted toward the top section to rest upon the cap portion and secured with the attachment means, preferably being a button or other decorative ornaments, when the wrap is in a wrapped position.

According to one embodiment of the head hair wrap/cap, the interior is substantially lined with an absorbent material. Preferably, being a terry material; or other absorbing material as in micro fibers and/or constructed with a hot/cold material so the wrap cap can be heated or chilled for regulating body temperature. Other materials contemplated for use in the interior and/or exterior include natural fibers such as cotton, wool, linen, and silk. The interior and/or exterior may be comprised of manmade fibers, such as spandex, polyester, satin, fleece, flannel, micro fibers, nylon, acrylic, acetate, and rayon. In a preferred embodiment, the interior is constructed of silk material as its properties keep hair from frizzing and/or to provide fashion or style to the head hair wrap/cap. In another preferred embodiment, the interior is constructed of cotton material to minimize static electricity when hair is dry hair and/or to provide fashion or style to the head hair wrap cap. There may be no interior layer for a more deposable wrap/cap combination. Preferably the exterior is composed of vinyl, plastic, water resistant/water impermeable material in fashionable materials to ensure that the hair does not get wet or damp owing to external climatic elements. The interior and exterior may consist of a silk for just sleeping or fashion. An additional the basic of the wrap/cap structure and ties can be executed in all rubber as an all water protective head wrap hair cap combo (swim cap) for swimming and water protective polyester, nylon, acrylic, acetate and rayon material interior to be less harsh on the hair and easier to place on the head while maintaining the hair style. Preferably, each of the ties includes foam with or without wire located in a bottom of the ties is adapted to hold, secure when twisted. However, a softer water protective material can be used inside the ties in place of the wirer+foam for a softer hold especially good for sleeping and fashion or as a deposable item. The ties can be omitted and the cap or top section will still remain secure around the head. The pouch's attachment means is adapted to mate with attachment means of the top section (preferably, being an elastic loop adapted to receive the preferable button or a decorative customized stay or fasten respectively). The elastic loop can be changed to a magnet appointed to be received by opposite polarity magnetization instead of a button, or exchanged for hook and loop fasteners, such as those commonly sold under the trademark VELCRO, with the opposite mate for closure. Other fasteners can be used, such as hook and eye, loop, snaps, and/or twists, as a way to secure twist when received on the top section of wrap/cap.

BRIEF DESCRIPTION OF THE DRAWINGS

The invention will be more fully understood and further advantages will become apparent when reference is had to the following detailed description of the preferred embodiments of the invention and the accompanying drawings, in which.

DETAILED DESCRIPTION OF THE DISCLOSURE

Figure 1:
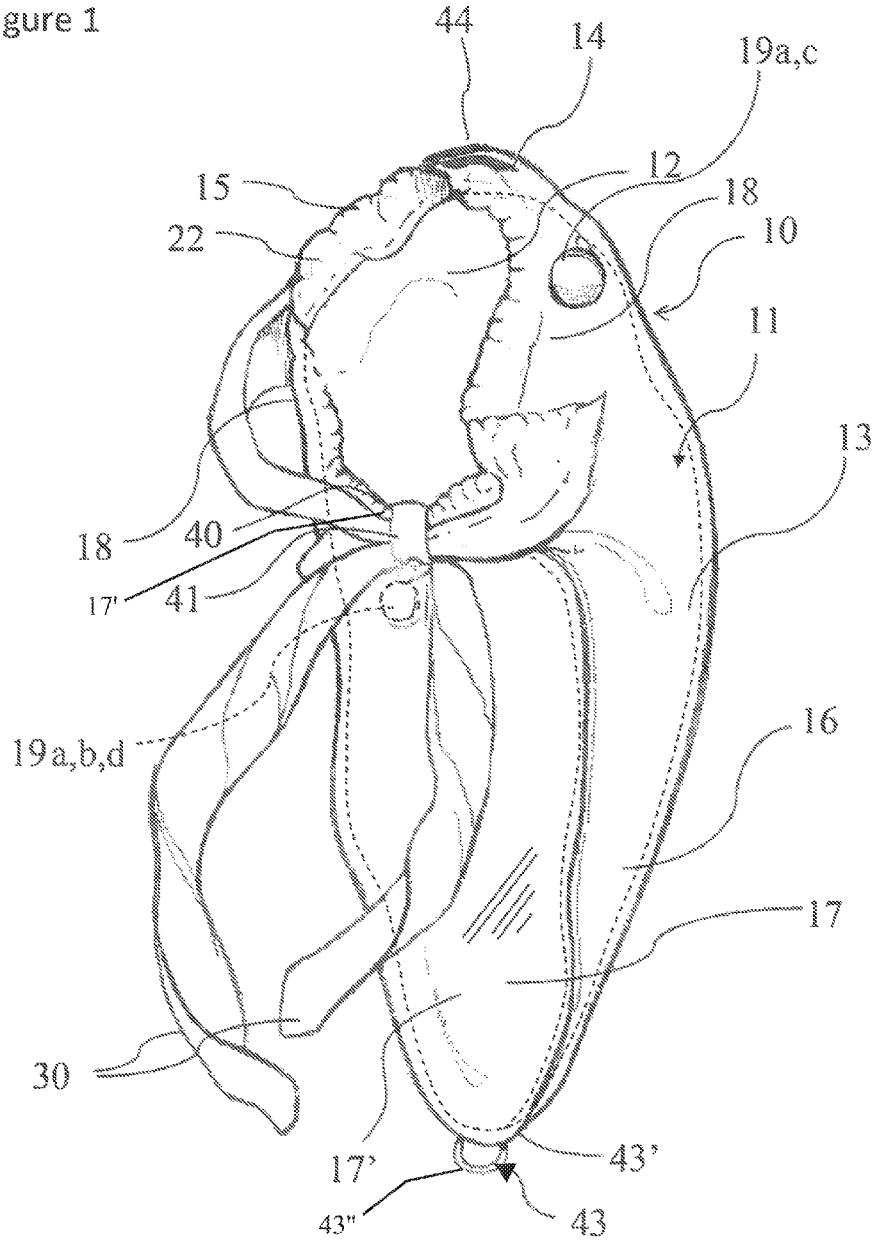
FIG. 1 is a top front plan view of an embodiment of the hair wrap hair cap combination.

The best mode for carrying out the present disclosure is presented in terms of the embodiments herein. The embodiments described herein comprise detail used for illustrative purposes and are subject to many variations. It is understood that various omissions and substitutions of equivalents are contemplated as circumstances may suggest or render expedient, but are intended to cover the application or implementation without departing from the spirit or scope of the present disclosure. Further, it is to be understood that the phraseology and terminology employed herein are for the purpose of the description and should not be regarded as limiting. The headings utilized within the description are for convenience only and have no legal or limiting effect.

The subject invention is directed to a head wrap hair cap combination appointed to transform from a wrap structure to envelope and fully contain the hair of the head. Accordingly, the subject head wrap hair cap combination is formed with a cap portion having two ties and terminating to an elongated pouch. While the cap portion protects the hair on the crown of the head, the elongated pouch receives and houses hair extending from the head. Short, medium, long and extra long hair lengths are readily accommodated by the subject head wrap hair cap combination, which is constructed in different sizes or lengths to correspond to short, medium, long and extra long hair lengths. The method to use and construct the head hair wrap cap combination preferably follows six (6) basic steps: 1) place the wrap body over head; 2) place hair in pouch; 3) pull both ties to tighten the wrap and then pull both ties up (when in forward position) and down (when in a backwards position) around head; 4) crisscross ties, loop under and tuck under opposite straps; 5) twist pouch up over head, to the either sides of head, back of head, top of head or base of head; 6) pull twisted pouch through crown loop or not depending on the style of twist and fasten the twist on button which will be determined by the style of twist on what button to be used. These six (6) basic steps can be used to apply the head hair wrap cap combination to short, medium, long and extra long hair lengths regardless of wearing wrap/cap in a forward or backwards position. All wrap/caps preferably have one to three button positions. The choice of button to fasten the end loop on depends on the desired style and is determined by the length of the pouch.

Accordingly, the extra long wrap length is configured to rest below the bra strap and extends to the waistline of an average height female. Generally, the length of the extra long wrap ranges from about 21 inches to 30 inches beneath the base of the wrap or beneath the cap portion. To apply the wrap onto the head, the user basically applies six steps. First, the user directs her head down towards the knees and applies wrap backwards with the ties at the front of head and the perimeter rim at the base of neck. The ties are then pulled down and around the base of neck, looped under each other, tightened and tucked on opposite sides of head by the ears. The pouch is then twisted into a cinnamon bun shape at the front of head and the twist is fastened with the end elastic loop on the button located at the side of either the right or left side of head by the ears or on the button located under the crown or base material loop. The x-long wrap can also be worn in the same forward fashion as the long wrap, short wrap or medium wrap. Then the pouch is then twisted into a cinnamon bun over the right or left shoulder and fastened on a button at the side of the head by the ear on either the right or left side or twisted centered at the base and fastened at the buttons under the crown material loop or the base material loop. The long wrap when applied forward with the perimeter rim on front of head; the same steps are followed, as mentioned herein above in connection with the extra long wrap. For the long wrap, the pouch length should be slightly below the bra strap; typically ranges from about 18 inches to 21 inches there below. After applying forward in the basic six (6) steps set forth herein, the pouch is then twisted, pulled up over back of head, pulled through the crown loop and fastened by the elastic end loop on the side button above the ear either to the right or left side of head or twisted in a rosebud over either the right or left shoulder and fastened on the button on the right or left side of head by the ear or in a rosebud at the center base and fastened on the button located under the base material loop. The long wrap can be worn backwards following the six (6) basic steps described above as in the extra long wrap/cap with the pouch at the front of the head twisted in a rosebud shape, pulled through the crown material loop and fastened on the button to the right or left side of the head now located below the ear. The pouch can be twisted clock or counter clock ways which may then determine if the button to the right or left side is used for fastening. This may coincide if depending on whether the person applying the head hair wrap is right handed or left handed, which is why the button is offered on either the right or left sides of head. The subject wrap/cap is appointed to be offered for a right handed or left handed application.

Preferably the short wrap length is to the shoulders of a user. Generally the short wrap has a length ranging from between 1 inch to 12 inches from the base up to 15 inches. Application of the short wrap onto the head follows the 6 basic steps. To apply forward the user places the wrap/cap on head, then places the hair in the pouch, pulls the ties up and around the head, loop the ties under each other, tightened and tucking each end under one another on the opposite sides. Then, the pouch is twisted up over the head and fastened by way of the button located under the material crown loop or to the sides or either the right or left side of head on the button located above the ear. The short wrap/cap can again be worn backwards directing the head downwards toward the knees and applies the wrap with the ties at the front of the head and the perimeter rim at the base of the neck. The ties are then pulled down and around the base of the neck, looped under each other, tightened and tucked on opposite sides of the head by the ears. Then the pouch is twisted and fastened by the elastic end loop on a button located at the right or left side now below the ear and can also be twisted simply and fasten back on the button located under the crown material loop.

For the medium wrap, the length should be below the shoulders, and generally range between about 15 inches to 18 inches. To apply forward the user should follow each of the (6) basic steps. Thereafter, the pouch is twisted at the base in the shape of a donut and fastened on the button located under the material base loop or over the right or left shoulder and fasten on the button by the ear on the right or left side of the head. The pouch twisted pulled up over the head through the crown material loop and on the button on the center front of perimeter rim. The twist can be rotated to either the right or left side of head and fastened on the center button as well. The medium wrap can also be worn backward following the six (6) basic steps in which the donut shape twist is now on the top of the head fastened on the button located under the base material loop or back down the back of the head through the crown material loop and on the center button that is now located at the back of head. In addition to the four (4) wrap lengths there is optionally a mini wrap and an x-extra long wrap if needed.

The head hair wrap cap can be used as a decorative fashionable head wrap cap in cases the wearer has no hair. The wrap protects the hair or the head, as the case may be, if the wearer has very thin or no hair. The wrap does not need hair inside it to be functional. Irrespective of the amount of hair present, the wrap will hold tight on the head, and the pouch will still have shape to it when twisted with or without hair inside. The hair does not have to be well styled to be kept dry. This being said, the hair also can be wet when inside the cap because of the terry cloth lining which is moisture absorbent. Optional interior material is contemplated; such optional hot/cold material will additionally aid in keeping the hair dry and kept by regulating the body's temperature to create there within a micro climate best suited to achieve this objective despite variance in climatic wearing conditions and activities. Other additional interior material may also include silk or satin so that the hair will not frizz up and the wrap/cap with both the interior+exterior for sleeping and fashion. The wraps may also then exclude the wirer+foam inside the ties in exchange for a water protective material or just foam for a more comfortable sleep or for a deposable wrap/cap combination. The wrap/cap can be twisted and worn in many versatile ways however; the wearer may discover different ways to twist the pouch for a different style so they may also choose to change the button placement. This will not hinder the protective nature of the head wrap hair cap combination because the elastic and ties remain both secure around the head and solely effect the pouch being twisted to a desired style.

A head wrap hair cap combination according to the invention is appointed is made in form of a rain cap and shower for use in the shower and/or rain to keep hair dry, or to protect hair styles while sleeping, working or running errands. A terry cloth interior is provided to give the option of wearing the wrap after a shower or bath when the hair is wet and may be offered in a full terry material interior and exterior for salon use. Improvements to current shower caps are yielded through use of the hair wrap. While other wrap type devices are generally made to mimic a towel when hair is wet, the subject hair wrap is adapted to provide an improved shower cap designed for hair. The subject hair wrap is adapted to be twisted up or left undone hanging on the back (so hair style is not ruined.) It also can be used to protect hairstyle while sleeping, working out or as even as a fashionable head wrap when running errands around town. It may be done in a vinyl/plastic exterior with or without an interior and ties done with or without wire and foam for a deposable wrap cap combination. A softer water resistant material may be used in ties instead for shape.

Figure 2:
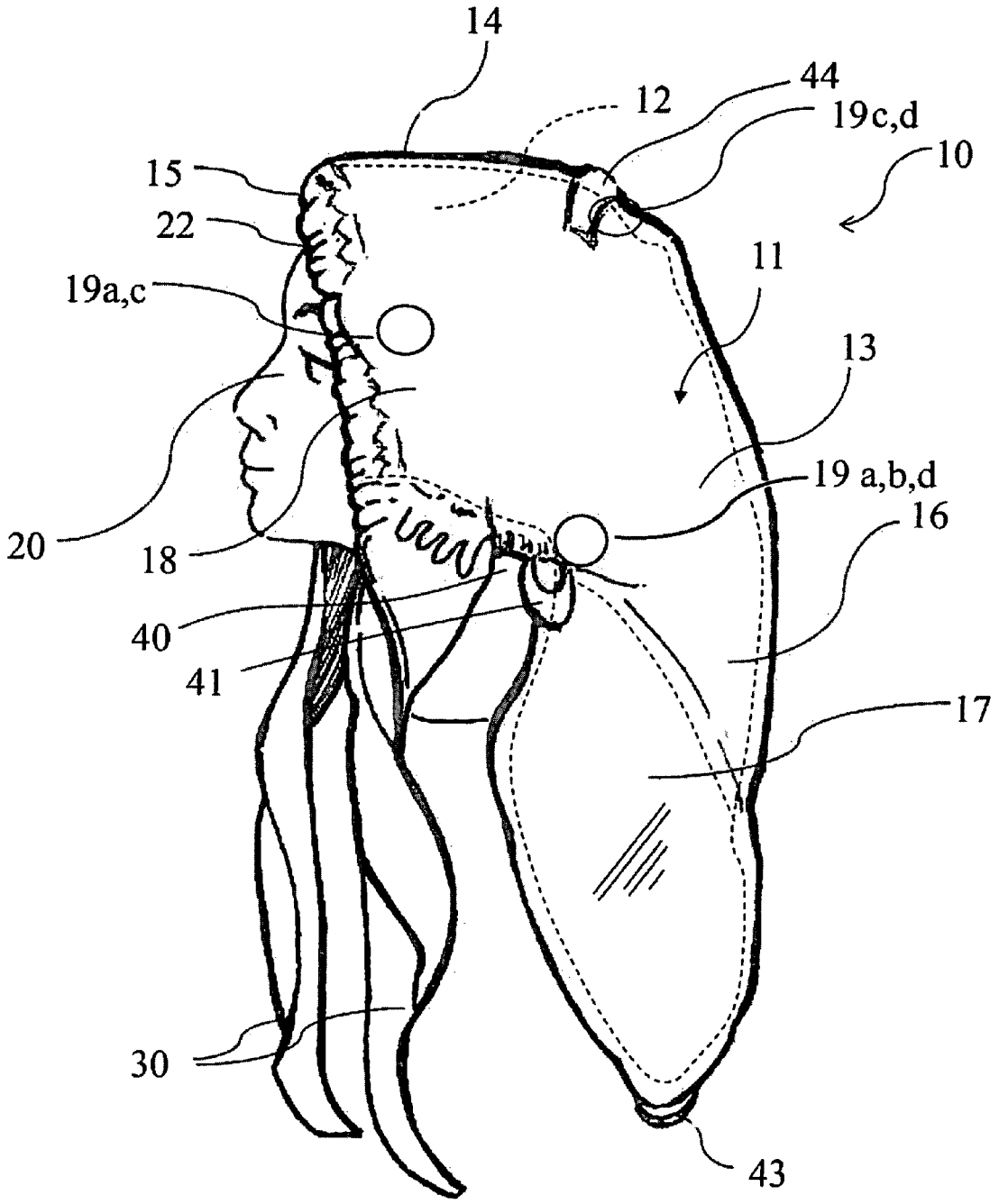
FIG. 2 is a side view of the hair wrap of FIG. 1.
Figure 3:
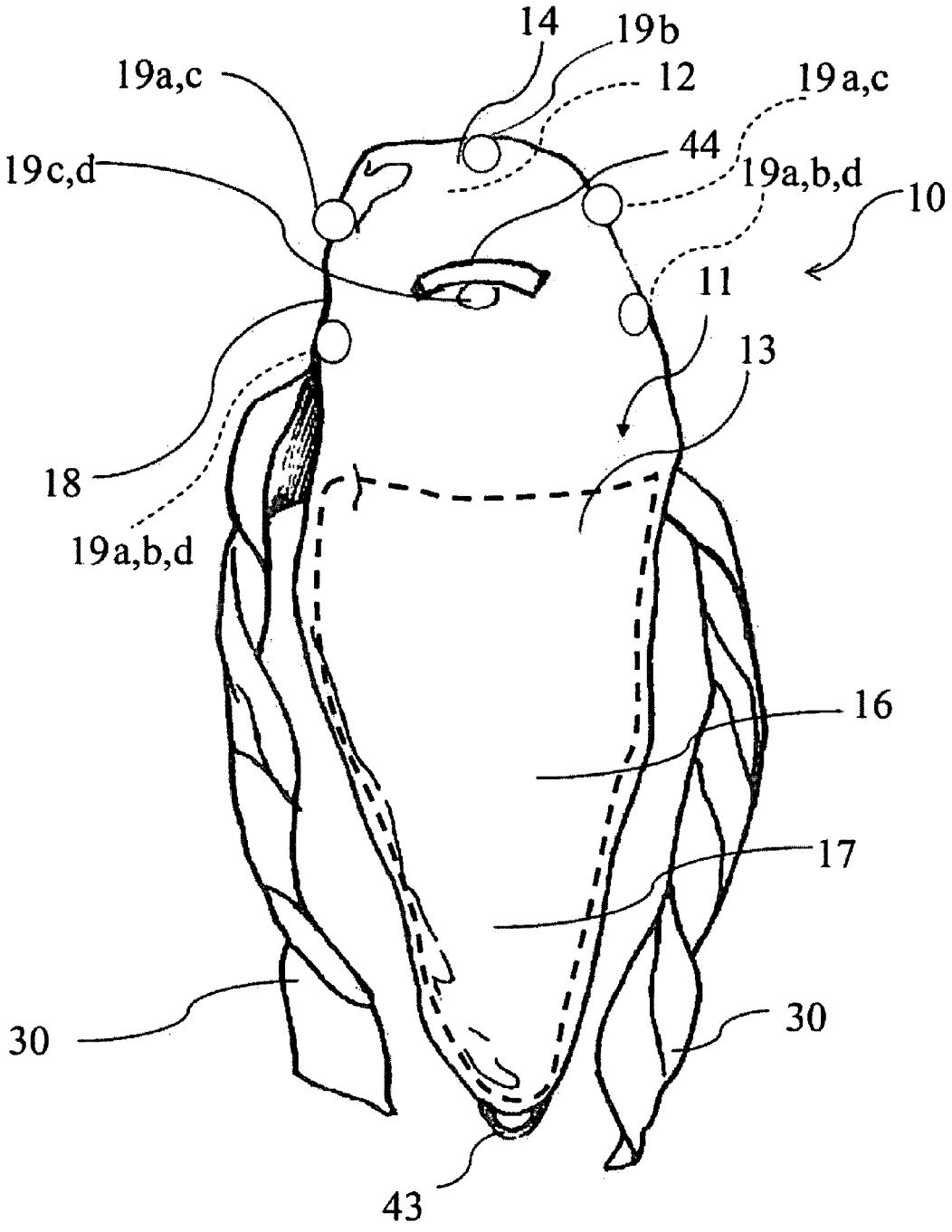
FIG. 3 is a rear of the hair wrap of FIG. 1.
Figure 4:
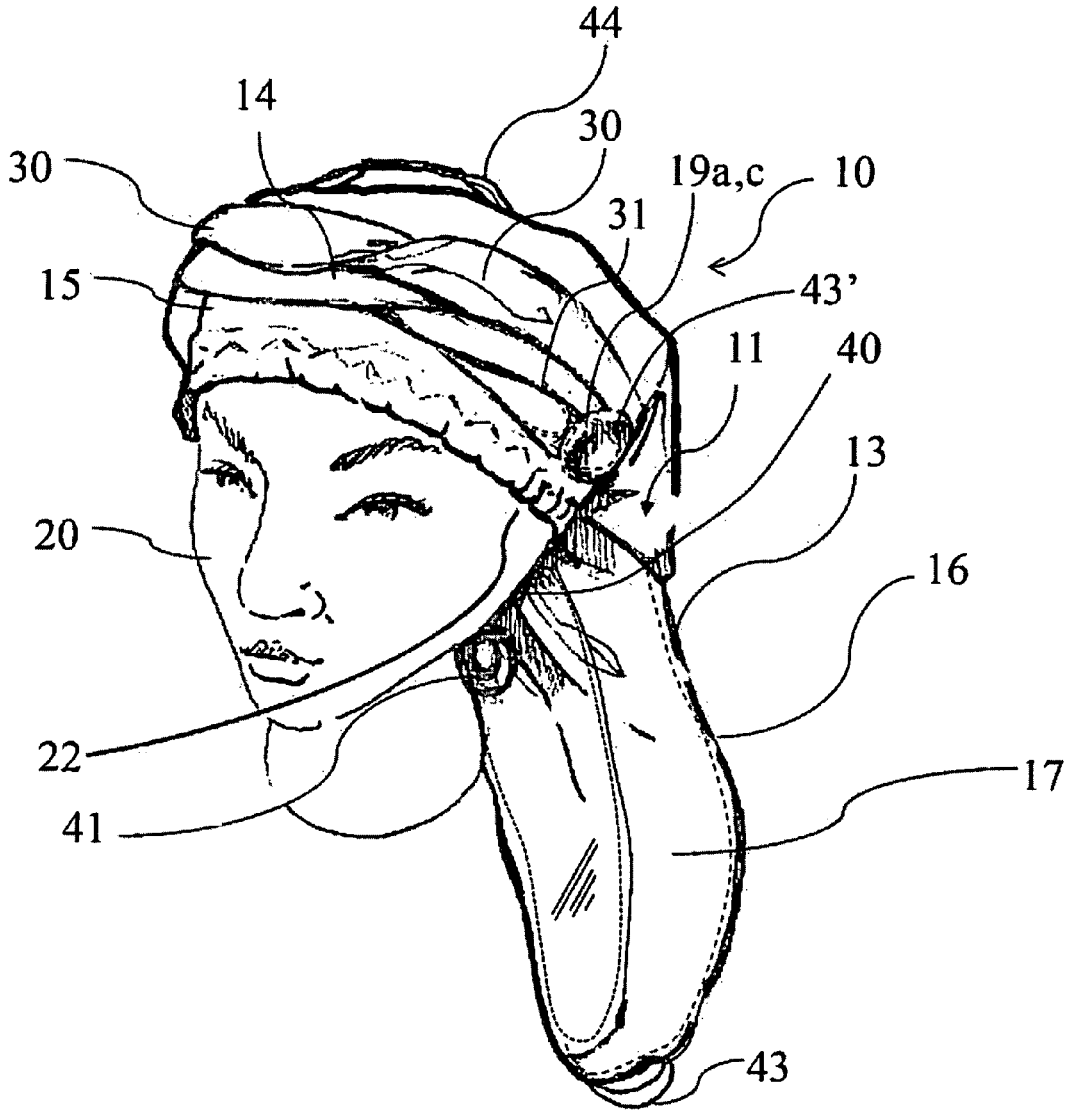
FIG. 4 is a frontal view of the hair wrap of FIG. 1, wherein the wrap is placed on a user's head and the pouch is in the extended position.
Figure 5:
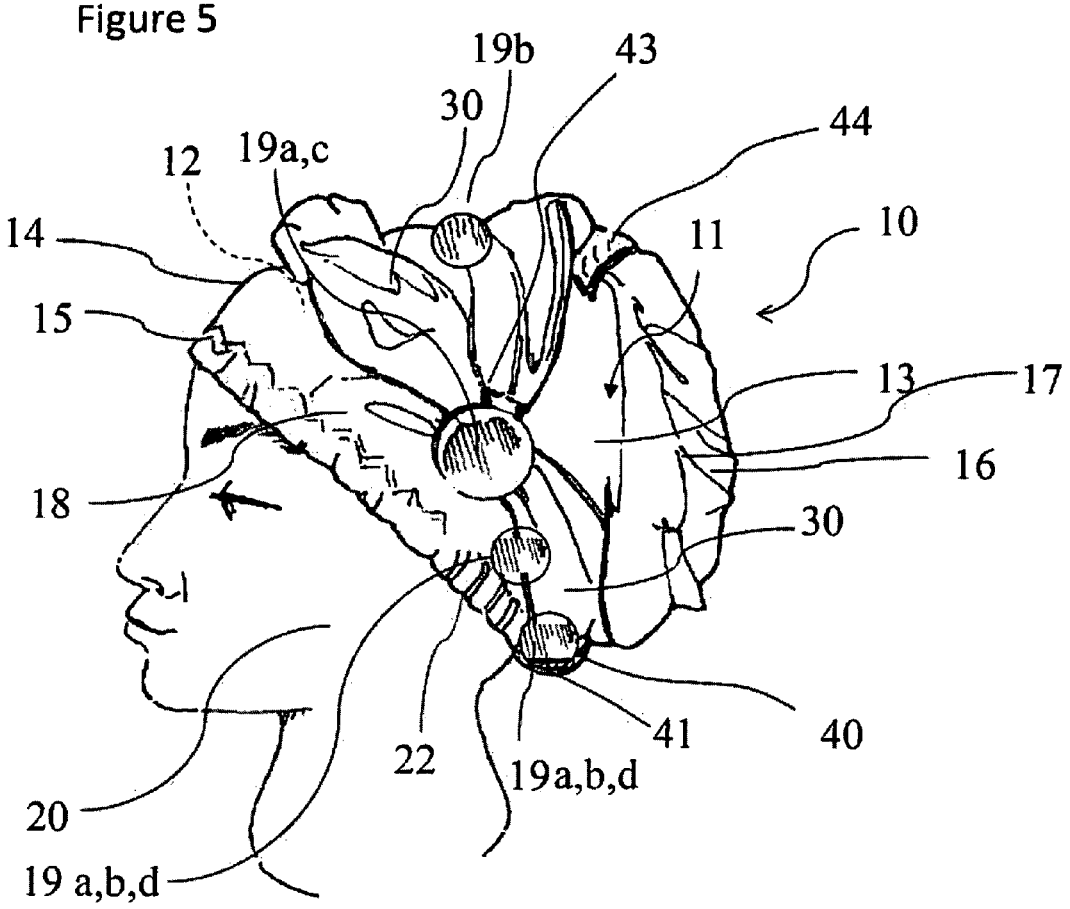
FIG. 5 is a side view of the hair wrap of FIG. 1, wherein the wrap is placed on a user's head and the pouch is in the twisted and wrapped position.
Figure 6:
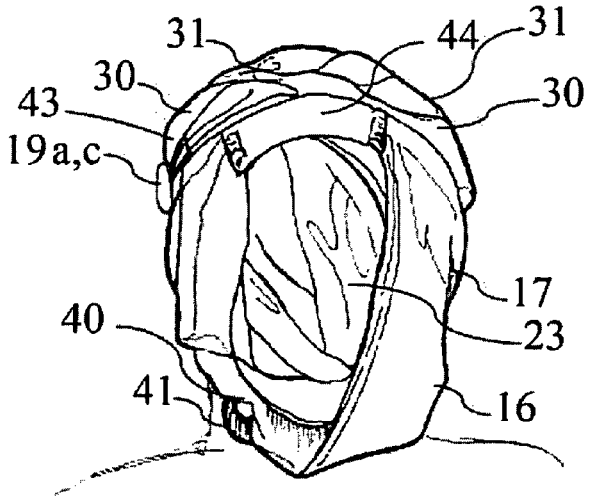
FIG. 6 is a rear view of the configuration of FIG. 5.
Figure 7:
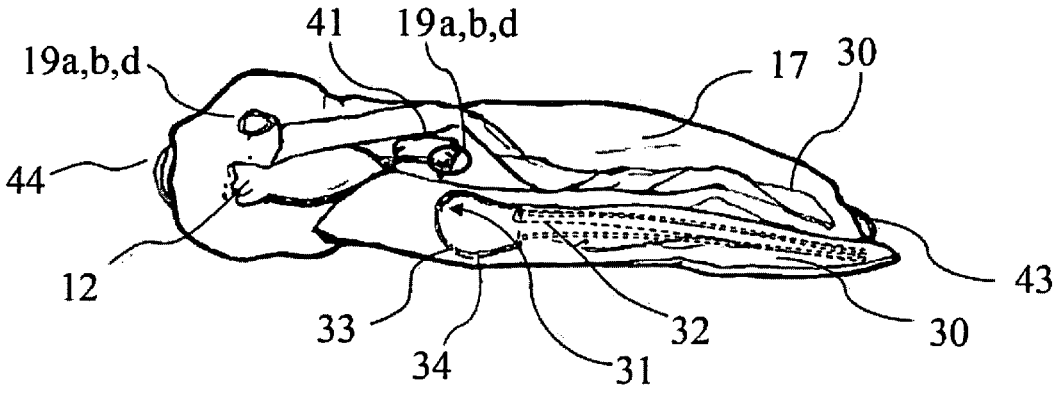
FIG. 7 is a top plan view of the hair wrap of FIG. 1, wherein the wrap is folded, removed from the head and placed for later use.
Figure 8:
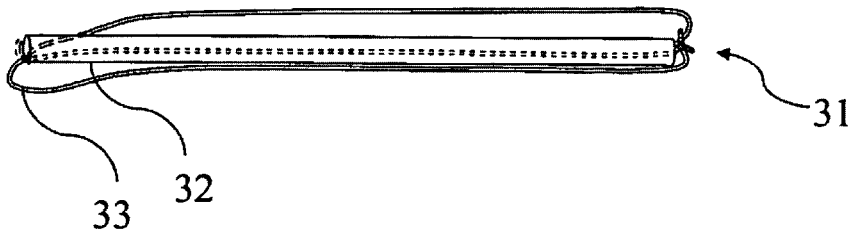
FIG. 8 is a top plan view of the hair wrap of FIG. 1, showing the foam with wire located in the ties.

FIGS. 1-8 illustrate a first embodiment of the hair wrap. FIG. 1 illustrates a top plan view of an embodiment of the hair wrap hair cap combination, shown generally at 10. FIG. 2 illustrates a side view of the hair wrap of FIG. 1. FIG. 3 illustrates a rear view of the hair wrap of FIG. 1. FIG. 4 illustrates a frontal view of the hair wrap of FIG. 1, wherein the wrap is placed on a user's head and the pouch is in the extended position. FIG. 5 illustrates a side view of the hair wrap of FIG. 1, wherein the wrap is placed on a user's head and the pouch is in the twisted and wrapped position. FIG. 6 illustrates a rear view of the configuration of FIG. 5. FIG. 7 illustrates a top plan view of the hair wrap of FIG. 1, wherein the wrap is folded, removed from the head and placed for later use. Lastly, FIG. 8 illustrates a top plan view of the hair wrap of FIG. 1, showing the foam with wire located in the ties.

As shown generally in FIGS. 1-8, the hair wrap 10 for enveloping hair comprises a main body 11 having an interior 12 and an exterior 13. The wrap is made up of two sheets forming the interior 12 and exterior 13 layers of the wrap 10. A third interior layer may be provided between the two sheets for extra absorption properties or for providing extra thermal properties. The exterior is designed with material that is water protective. This supports the head hair wrap cap main function to keep the hair dry and kempt. The wrap is very versatile and can be worn in many ways such as (when showering, when it's raining, when sunning by the pool but not under water). Because of the attractive water protective material, the head hair wrap cap can be worn when running errands, working out and during outdoor activities and sports (such as rock climbing, riding a bike, motorcycling, riding in a covetable and the like. The cap can also be worn as a sleep cap. Twisting of the pouch while hair is inside protects and maintains the integrity of the hair. Damage to the condition of the hair is prevented. The cap properly protects the hair while maintaining the hair style of the wearer.

The interior 12 may be substantially or virtually entirely lined with an absorbent material for drying wet hair within the wrap 10. Terry cloth, cotton, micro fiber and other highly absorbent materials may be used. The interior can be constructed with different materials. Terry cloth material is well suited to absorb excess water or moisture. The terry cloth construction is such that when the hair is damp it can absorb moisture and thereby keep the hair from drying up too quickly when uncovered. This allows a person more time before styling the hair with a blow dryer. The terry cloth material also acts as an absorbent when wearing the wrap during work outs or during outdoor sports activities or in cotton for a more breathable material. Since the material is washable it is suitable for use when a hair treatment has been applied to the hair. The interior may comprise of a hot/cold material that can be heated in a hot cabby or cooled in the refrigerator. As mentioned above the hot/cold cloth material can be used when sitting under a dryer with a hair treatment on the hair. Whether hot or cold the hot/cold cloth will help to regulate the body's temperature. Such cloth material is well suited to be chilled for use when working out, during outdoors activities, when lying in the sun or to provide comfort during menopause or for migraine headaches. When heated it may also help with migraines or other health issues such as the application of topical ointments to promote hair growth. When heated, the wrap is well suited for cold weather use in cases the head is bald or has thin hair. The presence of water protective material makes it well suited for use in snow. It is preferable that the top section 14 of the cap and the bottom section of the elongated pouch 17 include the absorbent material to dry the user's full length of hair.

Main body 11 has a top section 14 formed as a cap portion with a perimeter rim 15 adapted to receive a head with hair. The main body is constructed of one solid piece of material which is seamless; and consists of a top section (which is the cap section that fits the head which then carries down the back of the neck into the main body of the design and into the bottom section to which the pouch of the wrap is connected). The top section is constructed to fit the head like a shower cap. Elastic preferably runs around the entire perimeter rim 15 of the head hair wrap cap. This enables the wrap/cap to hug tight against the edge of the face and, or hairline, so that the hair is secure from water or moisture. It is designed as one whole solid piece of material that goes completely around the head and is secured by elastic around the edges so no moisture/water is allowed underneath and the hair will remain dry and kempt. To apply the head hair wrap cap one opens elastic with both hands and then stretches while placing the head hair wrap cap over the head with the perimeter rim to the front of the face and the ties to the back base of head. The wrap/cap in (short, medium, long and extra long) can all be worn backwards as well as forwards.

The perimeter rim stops on top of the ears however when the ties are pulled the elastic stretches below the ears. The ties are then sewn horizontally onto the end of the perimeter rim band and onto the wrap top section. Then the elastic that goes from underneath the ears down and around the back base of the head hair wrap cap top section is simply enclosed in material and acts as the mouth of the pouch. The band is designed so when the ties are pulled the elastic stretches to make the perimeter rim band appear not puckered but flush to the face. This then gives the appearance of a scarf tied around the head and is not bumpy like a shower cap.

The bottom section 16—is an extension from the main body of the head hair wrap cap forming the top part of the pouch. The bottom section then has an additional piece of material sewn on the underneath side of bottom section which lies along the shoulders and down the back referred to as the pouch. The separate material underneath the pouch allows changing up of the color and/or texture so the head/hair wrap cap begins to take on more of a pattern in color and in the design if desired. The bottom section begins at the base and can be as long as the small of the back.

A bottom section 16 extends from and is attached to the cap portion/top section 14 and includes an interior wall 17' to form a pocket or pouch 17 enclosure having a pouch mouth opening 17'. Pouch 17 is adapted to receive hair extending from the head—such as short, medium, long or extra long hair strands. Main body 11 is formed having side walls 18 that extend between cap portion and top section 14 and pouch 17. The side walls comprise the inside interior along the side of the head. They are again constructed of one solid piece of material with the side walls hugging the sides of the head and secured by elastic. The side walls add shape while the head/hair wrap cap hugs the head when elastically-secured and closed by the additional security of the ties. Cap portion/top portion 14 preferably includes at least one attachment means located on the exterior 13 of the main body 11. In the present embodiment, the attachment means is shown at 19. The attachment means/button 19 is shown, however it is noted that the location of the button is provided in multiple places depending on which head/hair wrap cap it is on. For example, a button is shown as phantom 19 (a, b, c, d) to represent the button location for the long wrap 19*a*, the medium wrap 19*b*, for the short wrap 19*c*, and for the x-long wrap 19*d*. The wrap 10 represents all 4 wrap's and (a, b, c, d) represents the (4) lengths and where the button or buttons are placed. The button is used to secure the twist by the end elastic loop located at the very end of the pouch. However, each warp/cap (short, medium, long+extra long) may have at least (1-3) buttons or decorative ornaments used to fasten the pouch tight after it has been twisted using the elastic end loop to fasten. This allows the wrap/cap to have (1-3) different style per wrap/cap. The short has (1-2) buttons. The medium wrap/cap has (1-3) buttons and both the long+extra long have 1-3 buttons. The buttons or ornaments maybe customized or personalized with logos and may also include monograms or stitched on designs. The button maybe exchanged for a strong magnet for a closure option as well as a hook and eye, Velcro, loop or snap for additional options.

At least two elongated ties 30 are located on opposite sides of the sidewalls 18. The two ties are located on both sides of the head on top of the ears. The ties material may match exterior or the top and underneath or just the underneath material of the tie in a different material to add more pattern and color if desired in design. This may coordinate with the underneath material of the pouch or again different materials to add more pattern+color if desired in design. The ties are held in place by the material base loop 41. This is so when the ties are pulled up and around the top of head in a forward position. The material base loop helps to close the mouth of the pouch up tighter, to secure a shut condition. The ties are pulled down the sides back under the base and up to secure a shut condition during the backwards application. The two ties are crisscrossed, tied or twisted ½ way around and tucked under the opposite ties to secure a tight condition. Ties 30 are elongated and are adapted to fall past the sides of a user's ears and are ample in length to be pulled down and around then up over the user's head. The ties 30 are adapted to be twisted in front of the top section 14 for securing the wrap 10 on the user's head and mitigating water entry. As best illustrated in FIGS. 7 and 8, ties 30 may include a malleable foam insert assembly 31 constructed with a malleable foam tube 32 and polymeric coated wire 33 inserted within the bottom section of ties 30 to hold, secure and twist the ties in place. A rubber coated wire and foam tube 32 (small round cylinder) is placed and sewn inside the bottom of the ties. The ties material is twisted with the coated wire inside around the form (small round cylinder) inside to form the shape of the twisted ends. Then the ties twisted shape is sewn in place from the outside so the twist bottom section of ties stay twisted. When the ties are pulled to tighten the head/hair wrap cap around head the ties are then crisscrossed and tucked under the opposite side of ties to secure them in place. The form inside the ties gives more shape to the design and the wire holds the twist in the bottom section of the ties in place, thereby adding more shape, so that the ties also bend in the shape of the head to provide a personalized fit.

A material loop 41 is located on a back base 40 of the pouch 17 to receive and hold the ties 30 in place. The base 40 is located at the base of the neck. This is where the material base loop is located in the middle of the elastic of the pouch mouth opening. The pouch lies on the back. This is also where a button is located at the bottom under the material base loop to be used to fasten for the (medium, long and extra long wrap) with the elastic base loop. The material base loop is located at the base of the neck at the mouth opening of the pouch. The loop is sewn under the elastic of the pouch mouth. The ties either side of the wrap then goes through the loop and out the opposite sides. The width of the ties also secure the closure by lapping over the elastic band at the pouch mouth opening at the base and is not influenced by how tight the ties are both pulled as to be secured and well fitted. When the ties are grabbed by both hands at the base of neck and now pulled the wrap then tightens around the head because of the ties being pulled though the loop up and around the top of head, crisscrossed, tied and tucked on opposite sides of the head. The material base loop also assists so the mouth of the pouch is pulled up tighter to close the opening of pouch and secure from water. However, the ties can still be pulled tight and are just as affective with securing the head/hair wrap cap tight when used without the ties going through the material base loop. The wrap can be worn with or without the use of the material base loop. Also; because the ties determine how tight the top section is to the head the wearer has the option to pull the ties loosely or not pulled so there is more room in the top section so hair volume+style remain full and still affective in preserving the hair from wetness. This may be desired when in the rain or even shower when pouch is left untwisted. The ties can be omitted for a simple shower cap/rain cap done with or without crown material loop and attachment to secure twist. However, this wrap/cap combo is design so all (4) length (short, medium, long+extra long) can be worn backwards so that the hair is pulled up on the top of the head so the hair volume at the root is preserved.

Additionally, an attachment means 43 is located on a bottom edge 43' of the pouch 17 for mating/fastening with the attachment means 19 of the cap portion/top section 14. A crown loop 44 is located on the top section 14 adapted to hold the pouch 17 after it is twisted and lifted toward the top section 14. The crown loop is designed on all four (4) (short, medium long and the x-long wrap/cap combinations so even if not used as in the short it is used to hide the button underneath. However the crown loop may be omitted on all four (4) wrap/cap combinations and the twist will still be functional. When the pouch is twisted in a forward position it can be pulled up over the back of the head, through the crown loop, twisted to the right or left side over the shoulders, pulled up then back down through the crown material loop or in the shape of a donut, rosebud or cinnamon shape. When wrap/cap is worn forward or backward, the twisted pouch can be fasten with the elastic end loop and depending on the length fastened to either the right or left button below the ear, by the ear, at the crown loop, base material loop or at the front or back center. The pouch can also be twisted in a cinnamon bun as in the extra long wrap forwards and backwards, a rosebud as in the long wrap forwards or backwards, a donut shape as in the medium wrap forwards or backwards and a simple twist for the short wrap in a forwards or backwards position. The wrap/cap can be applied with the pouch forwards or backwards with the pouch to the front top of the head or at the back by the base of the neck. All first (6) steps can be applied in the same backwards or forwards so that the cinnamon bun, rosebud, donut or a simple twist is now on the front forehead position or on the back by the base of the neck or in the other twisted pouch styles described within this document described above.

Accordingly, the pouch 17 is adapted to lay untwisted when the wrap 10 is in an extended position (as in FIG. 4) for maintaining a hairstyle or drying hair flat. Conversely, the pouch 17 is adapted to be twisted as shown at 23 in FIG. 6 and lifted toward the top section 14 to rest upon the cap portion and secured with the crown loop 44 and attachment means button 19 via loop 43 when the wrap 10 is in a wrapped position (as in FIGS. 5 and 6). Attachment means 43 may comprise an end elastic loop 43" located at the end of the pouch so that it can be fastened around the button to secure a twisted condition. It is on the end of the bottom section at the end of the pouch on all 4 head/hair wrap caps. The button is located on all 4 wraps in 1-3 places for different styles options. The long wrap and x-long wrap has a button option located in three 1-3 places; under the crown loop, a button on either the right or left side by the ear and a button underneath the base material loop. The long wrap has a button located in 1-3 places; under the base material loop as in the extra long wrap by the ear and a button above the ear to the right or left side of head. On the medium wrap, the button is located in 1-3 places; at the center top of perimeter rim and underneath base material loop and by the ear to either the right or left side of head. The short wrap has a button located in 1-2 places; to the right or left of the head above the ear and underneath the crown material loop.

The twist comes from the pouch and the bottom section when twisted. It can be twisted to the right or to the left over shoulders, front center, down at the base, up then back down, down and the back up, to the right or left of head, at the top or bottom. It is dependent on the length of the wrap/cap (short, medium, long or extra long) on the desired style by wearer and then fastened on the button by the elastic end loop. The button can be located on the right side of the head or the left side of the head above the ear or by the ear, center of the perimeter rim, under the crown material loop or under base material loop. Any of the (4) wrap pouch can be twisted in a forward position and all the same applies in a backwards position. When worn in a forward position, the twist on (long wrap) goes up and over the back of head through the crown loop and is fastened on a right or left side button above the ear, or twisted in a rosebud over the right or left shoulder and fasten on button by the ear or center under base material loop. The twist on (medium wrap) goes over either the right or left shoulder in the shape of a donut and is fastened on the button with the elastic end loop located to the right or left side of head by the ear, back up over the head through the crown material loop and center the perimeter rim or as a rosebud at the base of the neck fastened on the button located under the base material loop. The twist when pulled up over the head can also be repositioned to the right side of the head or left for a better sleeping position. The twist (short wrap) is twisted and rolled under and fastens on the button located under the crown material loop or to either side of the head to the right or left on the button located above the ear. The twist (x-long wrap) is either twisted at the base in a cinnamon bun shape and fastened on the button, with the elastic end loop being located at the side of the head to the right or left by the ear or up over the head through the crown material loop then back down the back of the head and fastened on the button located under the base material loop or a cinnamon bon at the base of the neck and fastened on button located under crown material loop. The x-long wrap can be placed on the head backwards with the base at the front top of the head then the cinnamon bun on the top of the head. The x-long wrap uses the same side right or left side button by the ear or it can fasten on the button located under the base material loop and the crown material loop. Again, the long, medium and short wrap can also be worn in a backwards as described with this document as well.

The pouch drops off the base, which is located at the back hairline and at the top of the base of the neck. The mouth of the pouch is an enclosed opening into which substantially all of the hair is allowed to fall. This is a unique design which allows the hair there within to remain unconstructed, as in a traditional shower/bath cap or rain cap. The pouch can be worn untwisted as in FIG. 4 or twisted as in FIG. 5. The pouch allows the hair to flow naturally down off the neck while protecting the hair from water or moisture, which then also protects the hair and its shape even when well styled. This is the separate material underneath the bottom section of the head hair wrap cap. The solid top section, main body, side walls and bottom section are separate from this piece of material, which is defines the pouch and the opening attachment into which the hair is placed so that it lays flat on the back.

Figure 9:
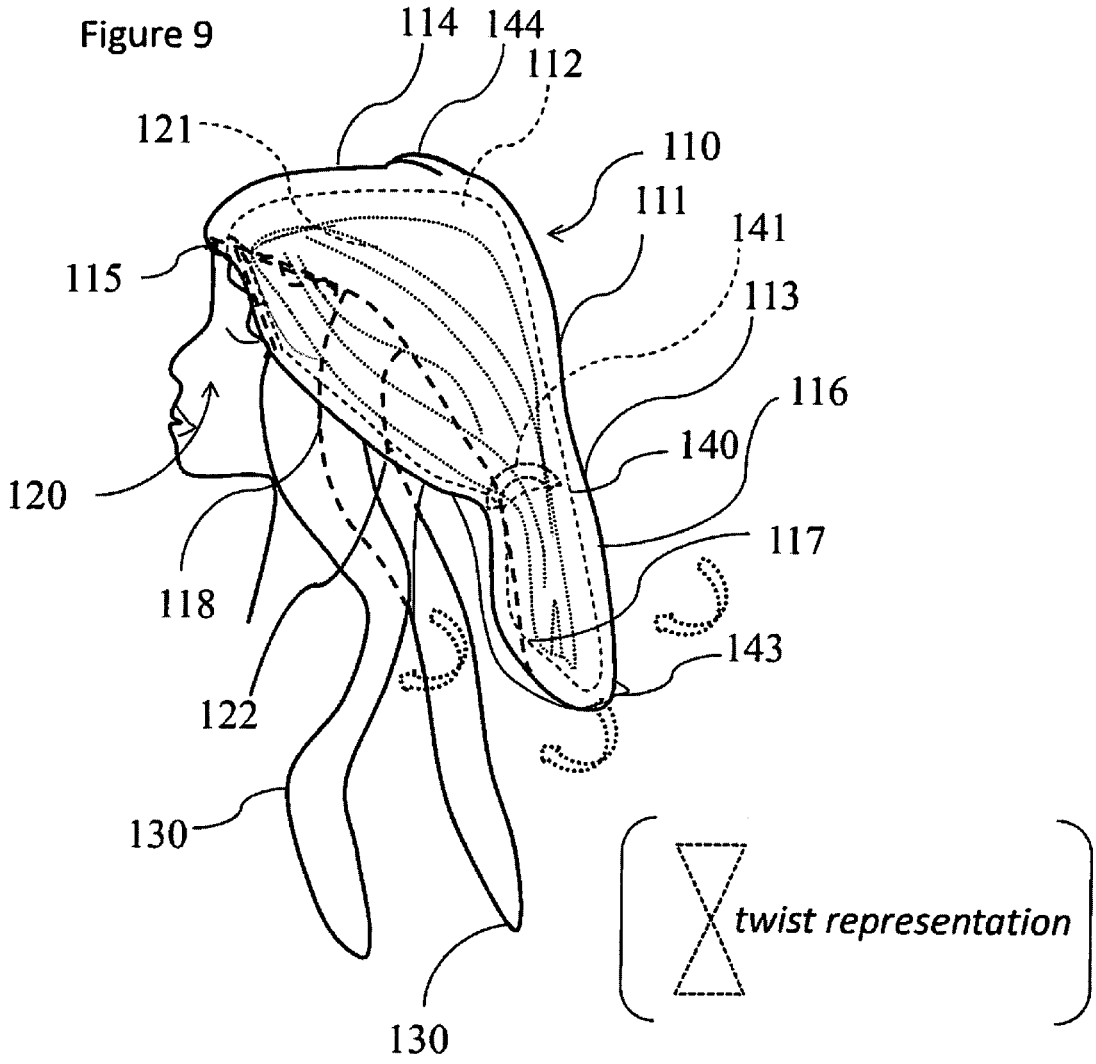
FIG. 9 illustrates another embodiment of the hair wrap, showing the wrap on a user's head wherein the wrap is placed on the head, but not yet wrapped and secured.
Figure 10:
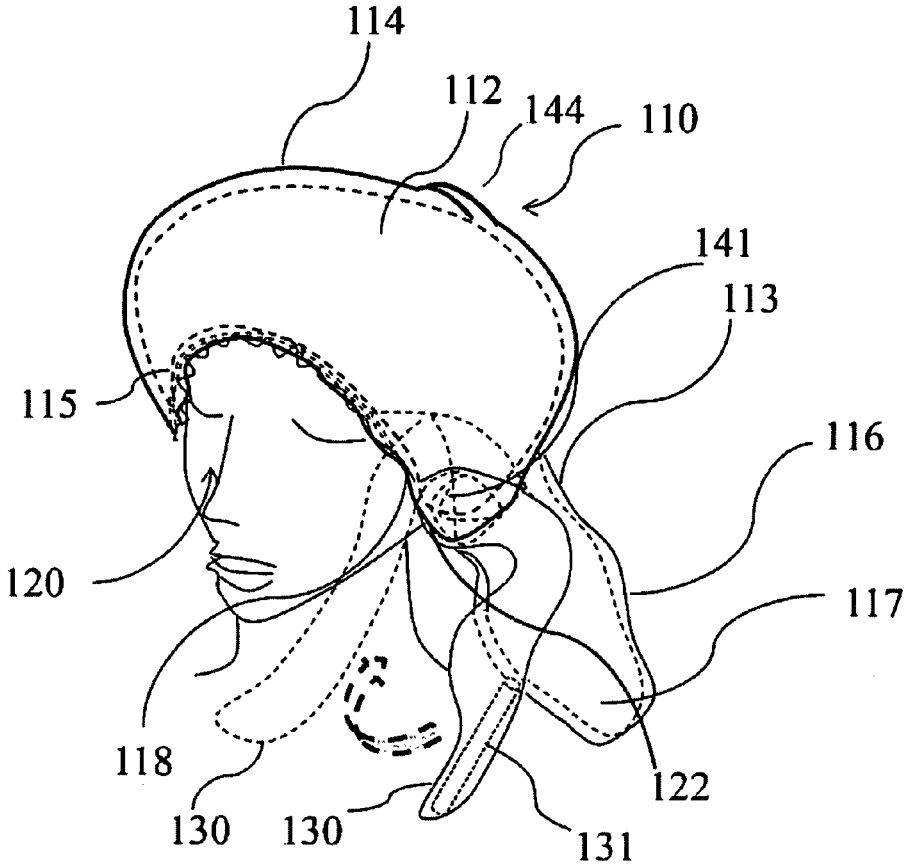
FIG. 10 illustrates the wrap of FIG. 9 wherein ties are secured, as in just before the bottom section of the wrap is twisted.
Figure 11:
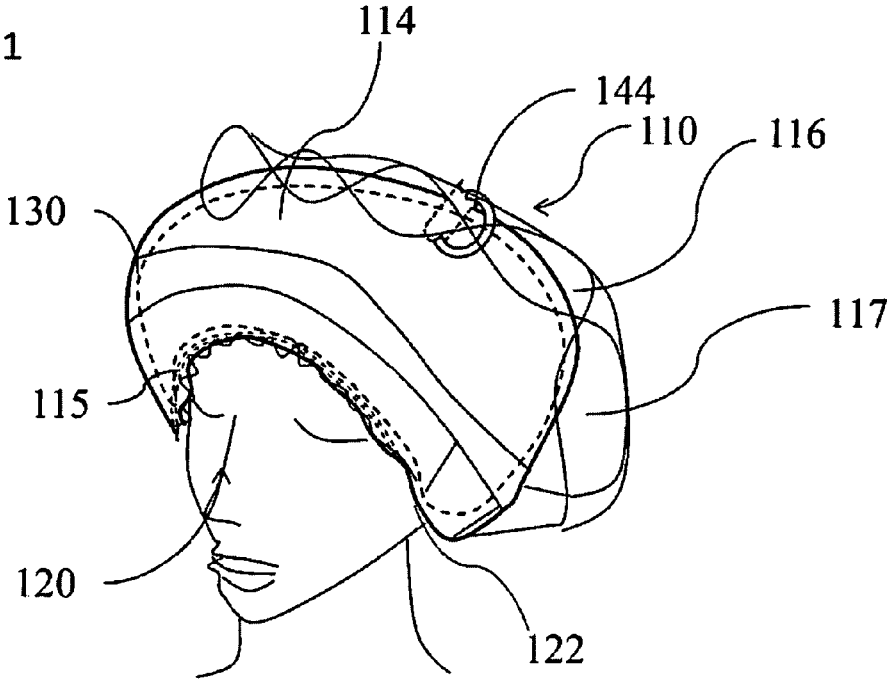
FIG. 11 illustrates the wrap of FIG. 9 secured to the head in a final configuration.

FIGS. 9-11 illustrate another embodiment of the hair wrap. FIG. 9 shows the wrap 110 on a user's head wherein the wrap is placed on the head, but not yet wrapped and secured. FIG. 10 illustrates the wrap 110 wherein ties are secured, as in just before the bottom section of the wrap is twisted. FIG. 11 shows the wrap 110 secured to the head in a final configuration.

Referring to FIGS. 9-11, the hair wrap is shown generally at 110. Wrap 110 generally comprises a main body 111 having an interior 112 and an exterior 113 formed having a top section 114 with a perimeter rim 115, a bottom section 116 forming a pouch 117, and side walls 118. Top section 114 is substantially formed as a cap portion appointed to fit a head and perimeter rim 115 is curved and includes a stretchable portion 122 (preferably, being an elastic band) preferably having at least one attachment means (preferably, being a button) [not shown]. The interior 112 is substantially lined with an absorbent material (preferably, being a terry cloth material; or other absorbing material). Alternatively, the interior 112 may be composed of a thermal material adapted to be chilled or heated to provide temperature treatment to the user. The exterior 113 is preferably composed of a water repellant/water impermeable material.

At least two elongated ties 130 are located on opposite sides of the side walls 118. Preferably, each of the ties includes foam with wire located in a bottom of the ties adapted to hold secure twist [see FIG. 8 at 31). The ties 130 are adapted to fall to sides of a users ears and are adapted to be pulled down and around then up over the user's head as depicted in FIG. 11. Ties 130 are adapted to be twisted in front of the top section 114 for securing the wrap 110 on the user's head and mitigating water entry to keep hair 121 dry and kempt/styled. A material loop 141 is located on a back base 140 of the pouch 117 and is adapted to hold ties 130 in place. The pouch 117 includes mating attachment means adapted to mate with the attachment means of the top section 114 (preferably, being an elastic loop adapted to receive the preferable button as shown at 143). The pouch 117 is adapted to lay untwisted when the wrap 110 is in an extended position (as in FIG. 9). On the other hand, pouch 117 is adapted to be twisted and lifted toward the top section 114 when the wrap 110 is in a wrapped position as shown in FIG. 11. A crown loop 144 is located on the top section 114 adapted to hold the pouch 117 after the pouch is twisted and lifted toward the top section 114.

Figure 12A:
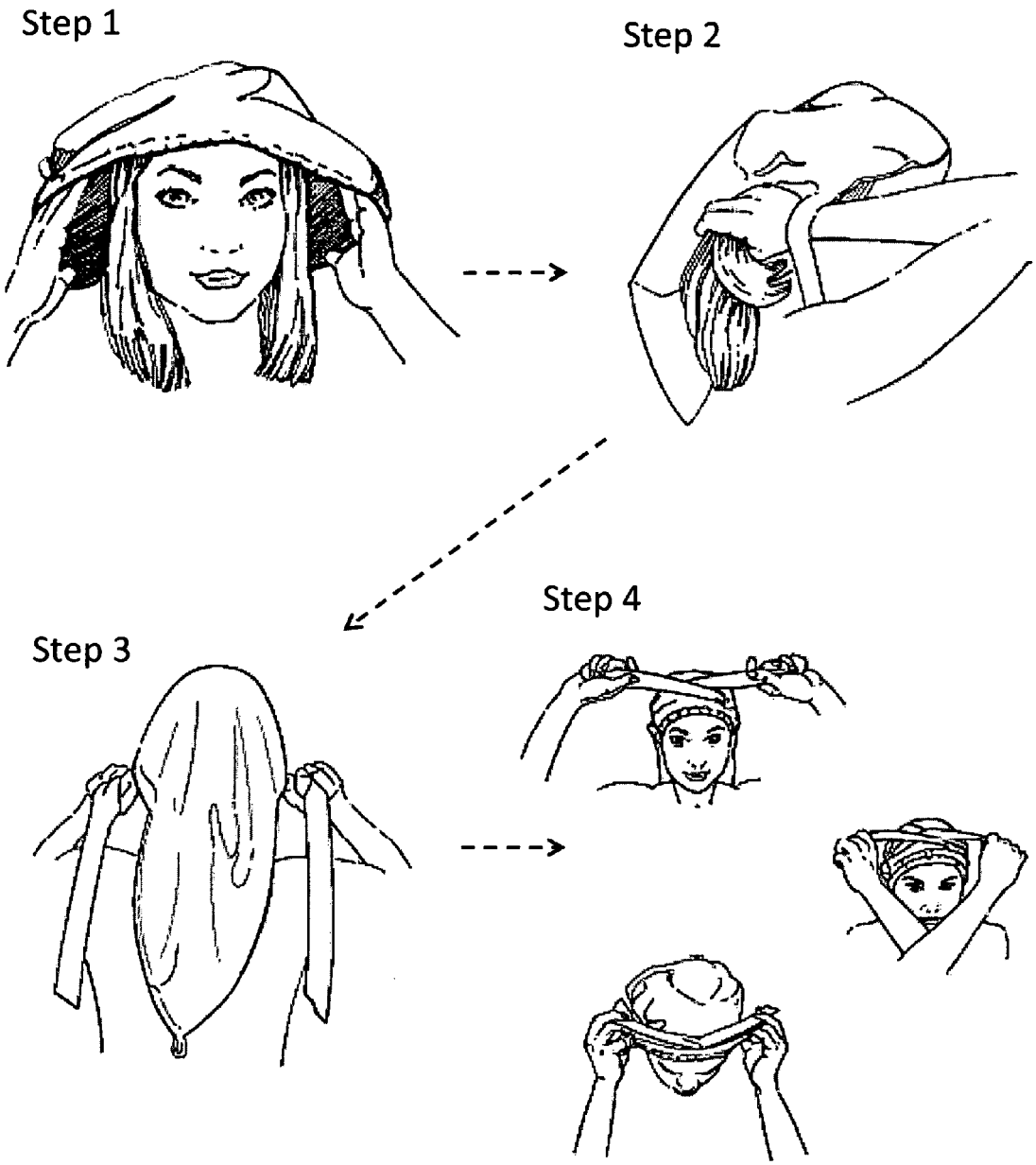
FIG. 12*a* illustrates steps 1-4, showing six (6) basic steps to apply and construct the wrap cap.
Figure 12B:
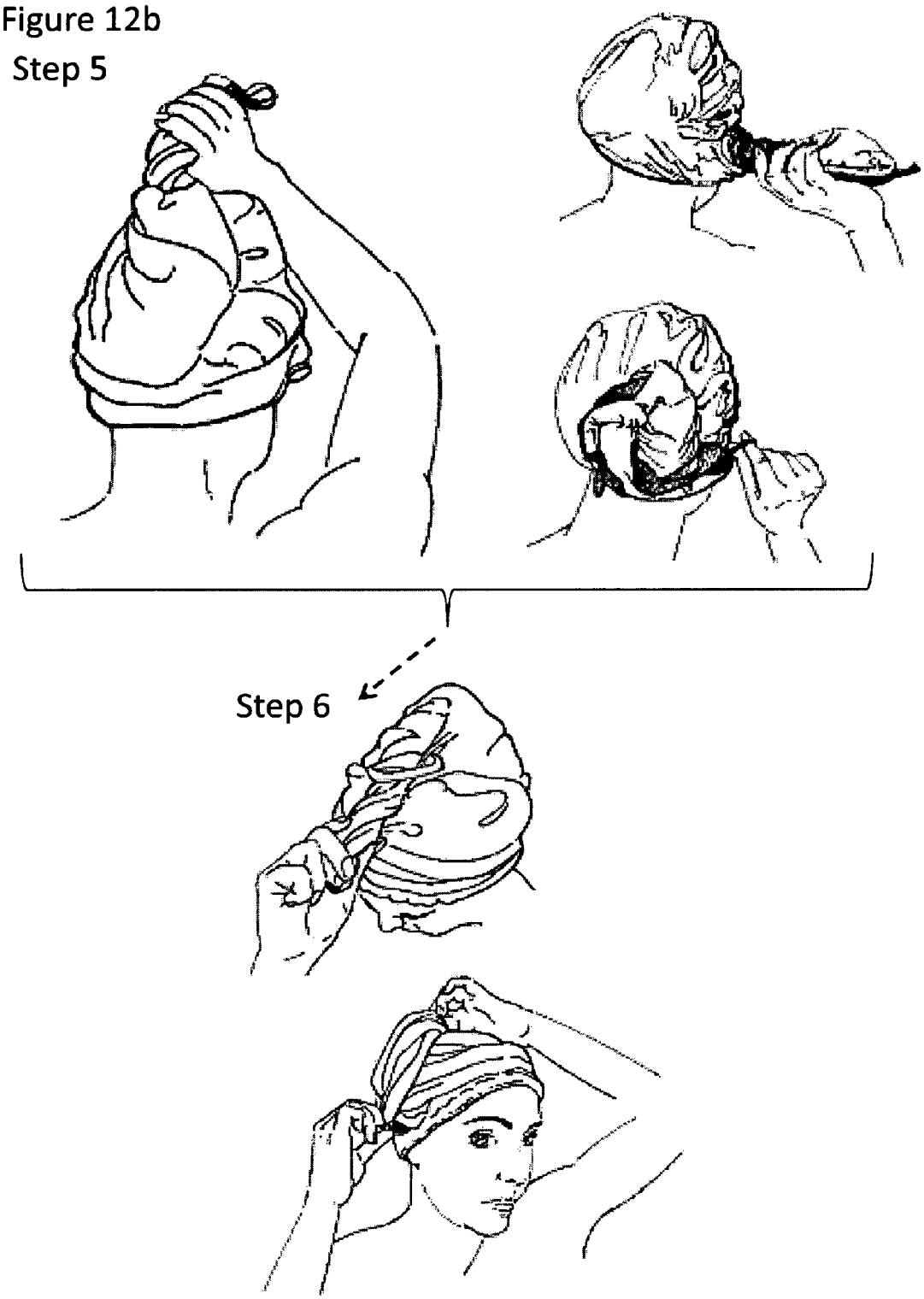
FIG. 12*b* illustrates steps 5-6, showing six (6) basic steps to apply and construct the wrap cap.
Figure 13:
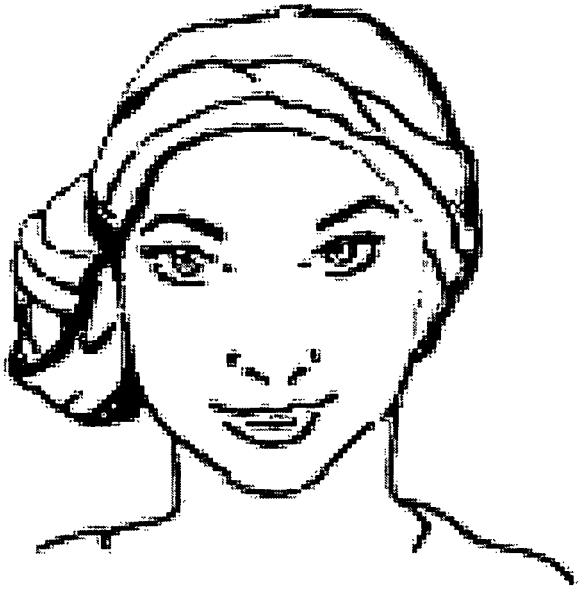
FIG. 13 illustrates a forward position final configuration.
Figure 14:
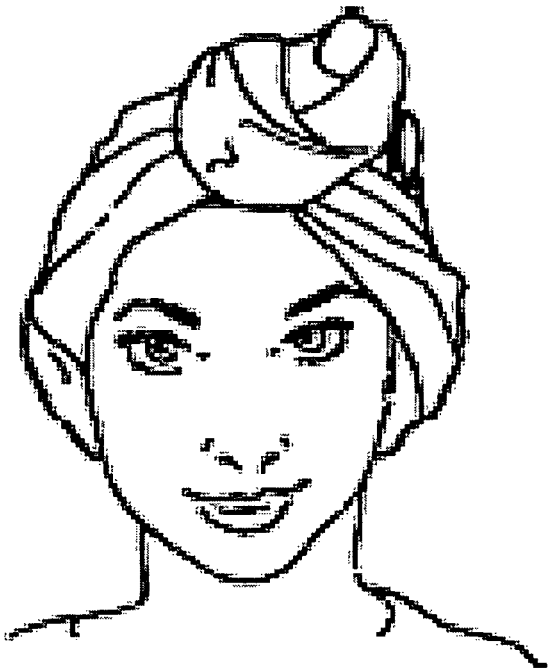
FIG. 14 illustrates a backward position final configuration.
Figure 15:
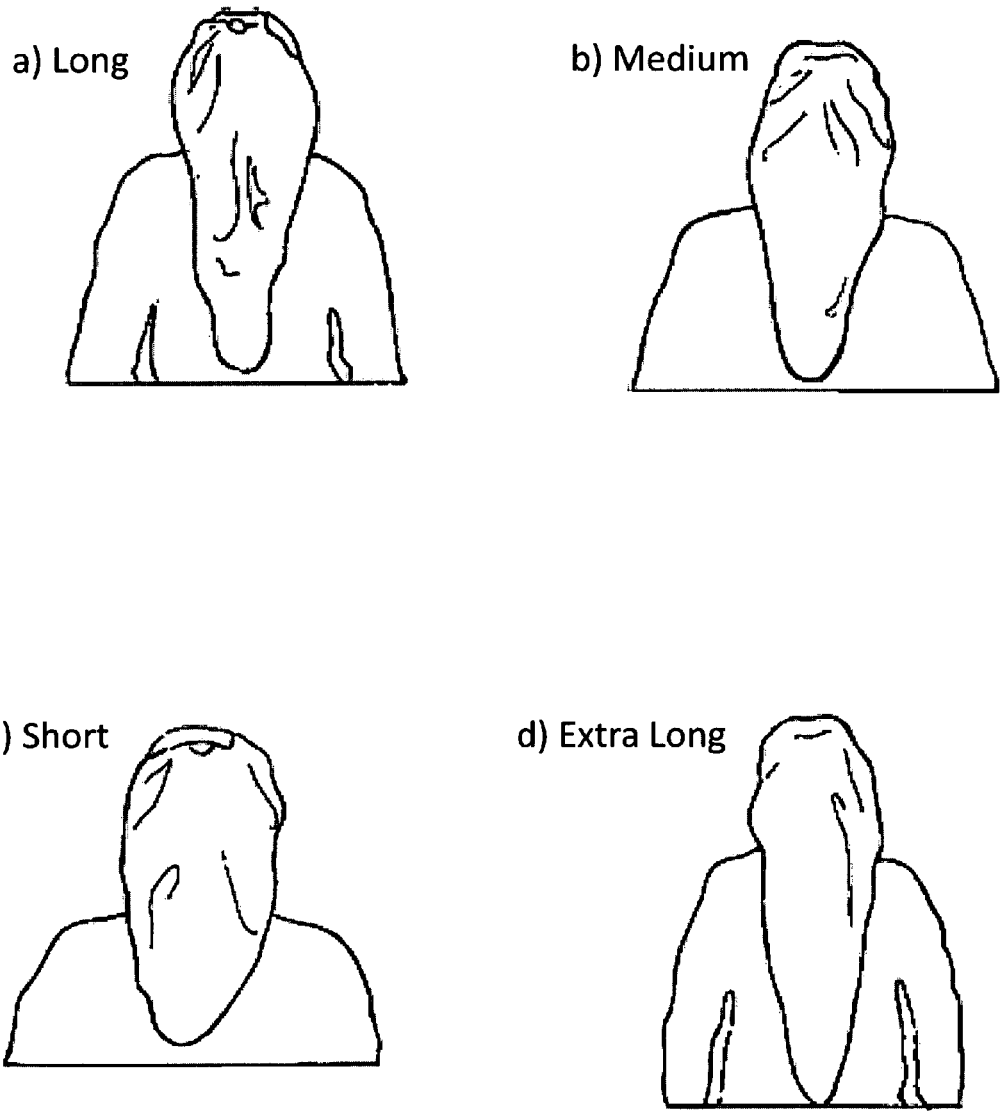
FIG. 15 illustrates four (4) wraps (long a, medium b, short c, and extra long d).

FIG. 11 illustrates the wrap of FIG. 9 secured to the head in a final configuration. FIG. 12*a* illustrates steps 1-4, showing six (6) basic steps to apply and construct the wrap cap. FIG. 12*b* illustrates steps 5-6, showing six (6) basic steps to apply and construct the wrap cap. FIG. 13 illustrates a forward position final configuration. FIG. 14 illustrates a backward position final configuration. FIG. 15 illustrates four (4) wraps (long a, medium b, short c, and extra long d).

A method of use and construct of the hair wrap is illustrated in FIGS. 12*a*-15. The subject hair wrap method of use includes the following steps as illustrated in FIGS. 12*a* and 12*b*, steps one through six (1-6): 1) place the wrap body over the head; 2) place hair in pouch; 3) pull both ties to tighten the wrap and pull both ties up over or down under the head; 4) crisscross ties at top or base of the head twisting ties ½ way around the head and tuck ties under straps; 5) twist pouch and pull twisted pouch up over, down to the back, to either sides, top or base of head; 6) pull twisted pouch through loop or not through the loop depending on style of twist and fasten twist on button that corresponds with the style of twist on all (4 lengths short, medium, long and extra long).

Alternative features of the subject invention are contemplated and non-limiting including, for example: the hair wrap may be constructed in a plethora of colors and designs; sizes; and lengths; etc. These features are contemplated in combination with the main embodiments shown in the Figures.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the present disclosure and various embodiments with various modifications as are suited to the particular use contemplated.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A hair wrap for enveloping hair, comprising:

a. a main body having an interior and an exterior and having a top section forming a cap portion and side walls with a perimeter rim extending along said cap portion and said side walls, and a bottom section extending from said top section and including an interior wall forming a pouch having a pouch mouth opening, said pouch mouth opening extending between and abutting said side walls and said perimeter rim of said top section;

b. said cap portion having at least one cap portion attachment located on said exterior of said main body, wherein said cap portion is appointed to fit a head;

c. at least two elongated ties located on opposite sides of said side walls substantially horizontal and parallel to said perimeter rim, said ties being adapted to fall to sides of a user's ears and adapted to be pulled down and around then up over a user's head, said ties being adapted to be twisted in front of said top section for securing said hair wrap on said user's head and mitigating water entry;

d. a material loop located on a back base on said pouch mouth opening of said pouch and said elongated ties going through said material loop and out opposite sides thereof said material loop being thereby adapted to receive and hold said ties in place at a base of a user's neck;

e. a pouch attachment located on a bottom edge of said pouch, said pouch attachment adapted to mate with said cap portion attachment;

f. a crown loop located on said top section adapted to hold said pouch after said pouch is twisted and lifted toward said top section;

whereby said pouch is adapted to lay untwisted when said hair wrap is in an extended position and to be twisted and lifted toward said top section to rest upon said cap portion and be secured with said cap portion attachment when said hair wrap is in a wrapped position.

2. The hair wrap as recited by claim 1, wherein said interior is substantially lined with an absorbent material.

3. The hair wrap as recited by claim 1, wherein said interior is substantially lined with a material that can be heated or chilled to regulate body temperature.

4. The hair wrap as recited by claim 1, wherein said exterior is composed of a water repellant or water impermeable material.

5. The hair wrap as recited by claim 1, wherein said pouch is an elongated pouch.

6. The hair wrap as recited in claim 1, wherein said cap portion's perimeter rim is curved and includes a stretchable portion extending circumferentially along said rim.

7. The hair wrap as recited by claim 6, wherein said stretchable portion is an elastic band.

8. The hair wrap as recited by claim 1, wherein said ties include a malleable foam insert with wire located within a bottom of said ties adapted to hold, secure and twist said ties in place.

9. The hair wrap as recited by claim 1, wherein said pouch attachment located on said bottom edge of said pouch comprises a loop.

10. The hair wrap as recited by claim 9, wherein said cap portion attachment comprises a button, and wherein said loop is adapted to receive said button.

11. The hair wrap as recited by claim 1, wherein said exterior of said main body has at least one button attachment.

12. The hair wrap as recited by claim 1, wherein said crown loop located on said top section is elastic.

13. The hair wrap as recited by claim 1, wherein said pouch attachment comprises an end elastic loop adapted to hold and secure said pouch in place.

14. The hair wrap as recited by claim 1, wherein said wrap is an extra long wrap having an extra long elongated pouch.

15. The hair wrap as recited by claim 1, wherein said wrap is a short wrap having a short pouch.

16. The hair wrap as recited by claim 1, wherein said wrap is a medium wrap having a medium length elongated pouch.

17. The hair wrap as recited by claim 1, wherein said wrap is a long wrap having a long length elongated pouch.

* * * * *